US008047872B2

(12) United States Patent
Burris et al.

(10) Patent No.: US 8,047,872 B2
(45) Date of Patent: Nov. 1, 2011

(54) COAXIAL ANGLE CONNECTOR AND RELATED METHOD

(75) Inventors: Donald Andrew Burris, Peoria, AZ (US); William Bernard Lutz, Glendale, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 12/837,044

(22) Filed: Jul. 15, 2010

(65) Prior Publication Data

US 2011/0021070 A1 Jan. 27, 2011

Related U.S. Application Data

(60) Provisional application No. 61/227,629, filed on Jul. 22, 2009.

(51) Int. Cl.
*H01R 9/05* (2006.01)

(52) U.S. Cl. ..... 439/582; 439/578; 439/271

(58) Field of Classification Search ..... 439/578, 439/271, 585, 582, 584, 320, 675; 29/747
See application file for complete search history.

(56) References Cited

U.S. PATENT DOCUMENTS

| | | | | |
|---|---|---|---|---|
| 2,755,331 | A | 7/1956 | Melcher | 174/87 |
| 2,813,144 | A | 11/1957 | Valach | 174/87 |
| 2,933,714 | A | 4/1960 | Overholser | 439/582 |
| 2,952,823 | A | 9/1960 | Robinson | 333/97 |
| 3,432,798 | A | 3/1969 | Brishka | 439/322 |
| 3,528,052 | A * | 9/1970 | Brishka | 439/582 |
| 3,665,601 | A | 5/1972 | Dunbabin | 29/629 |
| 3,731,378 | A | 5/1973 | Toma et al. | 29/629 |
| 4,400,050 | A | 8/1983 | Hayward | |
| 4,834,675 | A | 5/1989 | Samchisen | 439/578 |
| 5,338,225 | A | 8/1994 | Jacobsen et al. | 439/585 |
| 5,632,651 | A | 5/1997 | Szegda | 439/578 |
| 5,975,951 | A | 11/1999 | Burris et al. | 439/585 |
| 6,126,482 | A | 10/2000 | Stabile | 439/582 |
| 6,454,601 | B1 | 9/2002 | Vaitkus et al. | 439/578 |
| 6,733,336 | B1 | 5/2004 | Montena et al. | 439/578 |
| 7,018,235 | B1 | 3/2006 | Burris et al. | 439/584 |
| 7,144,272 | B1 | 12/2006 | Burris et al. | 439/578 |
| 7,179,121 | B1 | 2/2007 | Burris et al. | 439/578 |
| 7,182,639 | B2 | 2/2007 | Burris | 439/584 |
| 7,270,569 | B2 | 9/2007 | Petersen et al. | 439/582 |
| 7,331,820 | B2 | 2/2008 | Burris et al. | 439/578 |
| 7,419,403 | B1 | 9/2008 | Paynter | 439/578 |
| 2004/0029433 | A1 | 2/2004 | Lee et al. | 439/445 |
| 2004/0203283 | A1 | 10/2004 | Chen et al. | 439/578 |
| 2006/0113101 | A1 | 6/2006 | Wild et al. | 174/28 |
| 2007/0082510 | A1 | 4/2007 | Henningsen | 439/63 |

OTHER PUBLICATIONS

U.S. Appl. No. 12/391,468, filed Feb. 24, 2009, "Coaxial Connector With Dual-Grip Nut".

* cited by examiner

*Primary Examiner* — Javaid Nasri
(74) *Attorney, Agent, or Firm* — Matthew J. Mason

(57) ABSTRACT

A coaxial angle connector includes a pin having first and second ends, the first end being generally perpendicular to the second end. The pin is moveable from a first position to a second position in response to insertion of a coaxial cable into the connector and provides a positive visual indication of proper cable center conductor installation. The connector can also optionally include an coupling nut with a dual-grip surface.

19 Claims, 6 Drawing Sheets

COAXIAL ANGLE CONNECTOR AND RELATED METHOD

CROSS-REFERENCE TO RELATED APPLICATIONS

This application claims the benefit of, and priority to U.S. Provisional Patent Application No. 61/227,629 filed on Jul. 22, 2009 entitled, "Coaxial Angle Connector and Related Method", the content of which is relied upon and incorporated herein by reference in its entirety.

BACKGROUND

The disclosure relates generally to coaxial cable connectors, and particularly to angled coaxial cable connectors capable of being attached to a coaxial cable.

Coaxial cable connectors such as RCA, BNC and F-connectors are used to attach coaxial cable to another object such as an appliance or junction having a terminal adapted to engage the connector. F-connectors are often used in conjunction with a length of coaxial cable to create a cable assembly to interconnect components of a cable television system. The coaxial cable typically includes a center conductor surrounded by a dielectric, in turn surrounded by a conductive grounding foil and/or braid; the conductive grounding arrangement is itself surrounded by a protective outer jacket. The F-connector is secured over the prepared end of the jacketed coaxial cable by use of a crimp or compression tool specifically designed to actuate said connector. Once secured to the coaxial cable, the connector is then capable transferring signal by engaging a threaded connection found on typical CATV electronic devices such as taps and amplifiers.

Some connectors utilize what is known as a "pop up pin" feature. The pop up pin feature is useful to the connector installer as an indicator that the cable center conductor installation is properly accomplished within the connector. Pop up pin technology has been previously unavailable in angled connector designs due in no small part to mechanical design challenges presented by the movement of a pin around an angle.

Installation of a connector onto a corresponding externally threaded port is typically accomplished by rotating the coupling nut of the connector using finger pressure until the coupling nut cannot be further rotated by hand. Then, a wrench is applied to the typically hexagonal shaped coupling nut to secure the connection using the required amount of torque to ensure a dependable junction.

Historically, the hex size of a coupling nut on what is identified as the "male" connector is on the order of 7/16 inches with some versions sized at ½ inches or 9/16 inches. The 7/16 inch hex is, by far, the most common size utilized in the CATV connector field and, as a result, most tools i.e., wrenches, carried by installation technicians are of that dimension. These wrenches include both standard wrenches and torque limiting wrenches commonly known as torque wrenches.

The 7/16 inch hex size coupler is particularly well suited for use on connectors accepting series 6 cables and smaller because of their naturally compact size as dictated by the diameter of the corresponding cables. Typically, the bodies of these types of connectors are on the order of 7/16 inches in diameter allowing relatively easy access to the male connector coupling nut with fingers and various wrenches.

A problem, however, can arise when larger connectors, such as those capable of accepting series 11 cable, are utilized in the field. Said connectors typically utilize connector bodies on the order of 9/16 inches in diameter. This increased body size over that of series 6 connectors can obscure or at least partially obscure a coupling nut with a 7/16 inch hex configuration, making it difficult to reach said coupling nut for purposes of installation and removal from a female port.

One method used to address this issue is to employ a coupling nut with ½ or 9/16 inch hex configuration. However, this provides a difficulty for the field technician equipped with only a 7/16 inch wrench. In particular, this provides a difficulty for the technician who is required to use a comparatively expensive torque wrench on all connectors installed outside of a structure when his only torque wrench has an aperture of 7/16 inches.

Another problem often encountered with relatively larger connectors relates to withstanding forces applied essentially perpendicular to the axis of the connector. Forces induced by wind, snow load, or physically pulling on the cable are capable of mechanically breaking the outer conductor mechanism of many of the products currently on the market.

An additional issue encountered by the use of 7/16 inch coupling nuts on relatively large-bodied connectors is the resistance of said coupling nut to rotation when in contact with a sealing member, such as an o-ring or the like. The relatively small coupling nut is difficult to grasp by reaching around the large connector body and the impingement of the o-ring necessary to prevent moisture ingress renders the coupling difficult to rotate. Additionally, this impingement of said o-ring causes difficulty in rotation for couplers of various hex sizes, such as 9/16 inch hex and various other configurations.

In situations where larger hexagonal coupling nuts (coupling nuts on the order of 9/16 inches) are utilized, it is often advantages to rotatably attach said coupling nut to the related connector body by means of a retaining ring or snap ring. This type of arrangement, however, can be difficult to implement due to requirement of use of special factory assembly tooling and methods to ensure that said snap ring remains centered during assembly and is properly positioned after assembly.

Many of the applications noted above employ the use of straight connectors where the longitudinal centerline of the connector is coaxially aligned with the longitudinal centerline of the coaxial cable. The construction of angled connectors is typically more complex than the construction of straight connectors because of the difficulty of maintaining mechanical and electrical characteristics of the coaxial structure around an angled bend. Typically a fabricated center conductor is captured within the connector body and insulated with various dielectric configurations. Additionally, in angled connectors, it is often difficult to achieve comparable electrical performance to that of a straight connector due to interruptions in along the center conductor path.

SUMMARY

One embodiment includes a coaxial connector for attachment to a coaxial cable. The coaxial cable has a center conductor and a dielectric insulator surrounding the center conductor. The coaxial connector has a first end and a second end, and additionally includes a main body having a first end and a second end and an internal surface extending between the first end and the second end. The internal surface defines a longitudinal opening. The main body also has a first opening at the first end and a second opening at the second end, each opening having a longitudinal axis therethrough. The longitudinal axis of the first opening is generally perpendicular to the longitudinal axis of the second opening. An insulating member is disposed in the longitudinal opening of the main body. The insulating member has a first end, a second end, and an opening extending between the first and second ends of the insulating member. A insulating member. A pin extends substantially along the opening of the insulating member. The pin has a first end and a second end and each end has a longitudinal axis therethrough. The longitudinal axis of the first end of the pin is generally perpendicular to the longitudinal axis of the second end of the pin. The pin is capable of moving along the opening of the insulating member from a first position, in which the second end of the pin does not extend beyond the second end of the connector, to a second position, in which the second end of the pin extends beyond the second end of the connector, in response to insertion of the coaxial cable into the first end of the connector.

Another embodiment includes a method of assembling a connector for coupling an end of a coaxial cable to a port. The coaxial cable has a center conductor surrounded by a dielectric, the dielectric surrounded by an outer conductor, and the outer conductor surrounded by a jacket. The method includes disposing an insulating member into a longitudinal opening in a main body of the connector. The insulating member has a first end, a second end, and an opening extending between the first and second ends of the insulating member. The main body has a first end and a second end and an internal surface extending between the first end and the second end. The internal surface defines a longitudinal opening. The main body also has a first opening at the first end and a second opening at the second end and each opening has a longitudinal axis therethrough. The longitudinal axis of the first opening is generally perpendicular to the longitudinal axis of the second opening. The method also includes inserting a pin into and substantially along the opening of the insulating member. The pin has a first end and a second end and each end has a longitudinal axis therethrough. The longitudinal axis of the first end of the pin and the longitudinal axis of the second end of the pin are generally coaxial prior to insertion of the pin into the opening of the insulating member and the longitudinal axis of the first end of the pin and the longitudinal axis of the second end of the pin are generally perpendicular when the pin has been fully inserted into the opening of the insulating member.

One or more embodiments disclosed herein can provide advantages that include an angled connector that provides a positive visual indication of proper cable center conductor installation. Embodiments disclosed herein additionally include an optional dual-grip coupling nut. The coupling nut can be configured to be free-spinning while providing positive environmental sealing upon installation.

Additional features and advantages will be set forth in the detailed description which follows, and in part will be readily apparent to those skilled in the art from that description or recognized by practicing the embodiments as described herein, including the detailed description which follows, the claims, as well as the appended drawings.

It is to be understood that both the foregoing general description and the following detailed description present exemplary embodiments, and are intended to provide an overview or framework for understanding the nature and character of the claims. The accompanying drawings are included to provide a further understanding, and are incorporated into and constitute a part of this specification. The drawings illustrate various embodiments, and together with the description serve to explain the principles and operations of the various embodiments.

DETAILED DESCRIPTION

Reference will now be made in detail to the present preferred embodiments, examples of which are illustrated in the accompanying drawings.

Figure 1:
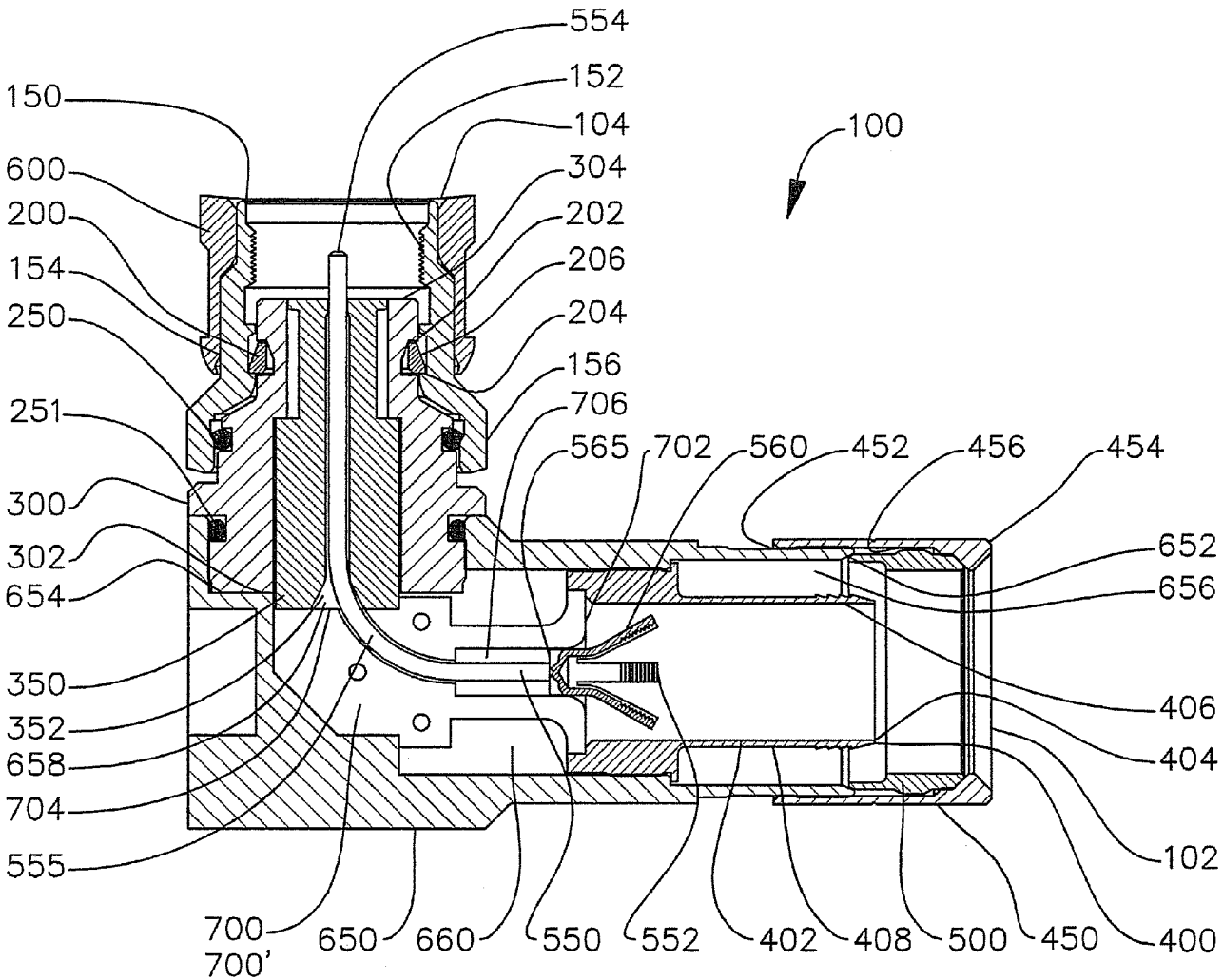
FIG. 1 illustrates a partial side cutaway view of an embodiment of a connector as disclosed herein.

FIG. 1 illustrates a partial cutaway view along the centerline of a preferred embodiment of a connector 100 as disclosed herein. The connector 100 shown in FIG. 1 has a first end 102 and a second end 104 and includes coupling nut 150, retaining ring 200, o-ring 250, o-ring 251, body member 300, insulator 350, post 400, compression ring 450, gripping member 500, pin member 500, pin 550, and optional seal ring 600, main body 650, and insulating member that includes first insulator component 700 and second insulator component 700'.

Main body 650 is preferably made from a metallic material, such as brass, and is preferably plated with a conductive, corrosion resistant material, such as nickel. Main body 650 has a first end 652, a second end 654, and an internal surface extending between the first end 652 and the second end 654, the internal surface defining a longitudinal opening 660. Main body 650 also has a first opening 656 at the first end and a second opening 658 at the second end, each opening having a longitudinal axis therethrough, the longitudinal axis of the first opening 656 being generally perpendicular to the longitudinal axis 658 of the second opening, such as at a right angle (90°) to the longitudinal axis of the second opening.

Insulating member includes first and second insulator components 700 and 700', and is disposed in the longitudinal opening 660. Insulating member has a first end 702, a second end 704, and an opening 706 (opening includes guiding channel 720 and 720' and partial bore 725 and 725' of first and second insulator components 700 and 700' as shown, e.g., in FIG. 2B) extending between first and second ends 702 and 704 of insulating member. First and second insulator components 700 and 700' are preferably made of an insulative plastic material such as high-density polyethylene or acetal.

Pin 550 is preferably made from a metallic material, such as brass, and is preferably plated with a conductive, corrosion resistant material, such as tin. Optionally, pin 550 may be in an annealed condition. Pin 550 extends substantially along opening 706 of insulating member. Pin 550 has a first end 552 and a second end 554, each end having a longitudinal axis therethrough, the longitudinal axis of the first end 552 of the pin 550 being generally perpendicular to the longitudinal axis of the second end 554 of the pin 550, such as at a right angle (90°) to the longitudinal axis of the second end of the pin. Pin 550 also includes pin shank 555, slotted fingers 560, and contact shoulder 565. Slotted fingers 560 assist in guiding the inner conductor of the coaxial cable into physical and electrical contact with the pin 550.

Coupling nut 150 is rotatably attached to the second end 104 of the connector 100 and is preferably made from a metallic material, such as brass, and preferably plated with a conductive, corrosion resistant material, such as nickel. Coupling nut 150 includes an internally threaded bore 152 for engaging a port, a first external gripping surface 154 having a plurality of flat sides, and a second external gripping surface 156 having a plurality of flat sides, wherein the sides, wherein the smallest outer diameter of the first external gripping surface 154 is less than the smallest outer diameter of the second external gripping surface 156. Preferably, the first and second external gripping surfaces 154 and 156 are hex-shaped.

Body member 300 has a first end 302 and a second end 304, the first end 302 of the body member 300 disposed through the second opening 658 of main body 650 and the second end 304 of the body member 300 disposed within an inner surface of the coupling nut 150. Body member 300 is preferably made from a metallic material, such as brass, and is preferably plated with a conductive, corrosion resistant material, such as nickel.

O-ring 250 is disposed about body member 300 and within the inner surface of the coupling nut 150. Limited contact or even clearance between o-ring 250 and the inner surface of coupling nut 150 permits limited axial movement of coupling nut 150 relative to body member 300 before internally threaded bore 152 of coupling nut 150 engages a port. The limited axial movement allows the coupling nut 150 to be free-spinning relative to body member 300 until the coupling nut 150 is tightened onto the port. O-Ring 250 and o-ring 251 are preferably made from a rubber-like material, such as EPDM (Ethylene Propylene Diene Monomer).

Retaining ring 200 is preferably c-shaped (not shown) and is disposed about body member 300 proximate to the second end 304 thereof and is, in addition, disposed within the inner surface of coupling nut 150. Retaining ring 200 has a front end 202, a back end 204, and an external taper 206 such that retaining ring 200 increases in outside diameter between the front end 202 and the back end 204. Retaining ring 200 is preferably made from a metallic material, such as heat treated beryllium copper.

Insulator 350 preferably has a generally tubular shape with an internal bore 352 and is preferably disposed between the second end 704 of the insulating member and the second end 104 of the connector 100. Insulator 350 is preferably made of an insulative plastic material, such as high-density polyethylene or acetal.

Post 400 preferably has a generally tubular shape and is disposed within the longitudinal opening 660 of main body 650. Post 400 includes a tubular shank 402 having a rear end 404, an inner surface 406, and an outer surface 408, wherein the outer surface 408 of the tubular shank 402 and the internal surface of the main body 650 define an annular cavity therebetween. Post 400 is preferably made from a metallic material, such as brass, and is preferably plated with a conductive, corrosion resistant material, such as tin.

Compression ring 450, surrounds first end 652 of main body 650. Compression ring 450 has a front end 452, a rear end 454, and an inner surface 456 defining a longitudinal opening extending between the front and rear ends 452 and 454 of compression ring 450. Compression ring 450 is axially moveable over the main body 650 between a rearward position (shown in FIG. 1) and a forward position (not shown in FIG. 1). Compression ring 450 is preferably made from a metallic material, such as brass, and is preferably plated with a conductive, corrosion resistant material, such as nickel.

Gripping member 500 is disposed within the longitudinal opening of compression ring 450. Gripping member 500 is preferably made of an insulative plastic material, such as high-density polyethylene or acetal.

Seal Ring 600 surrounds outer surface of coupling nut 150 and is preferably made from a rubber-like material, such as silicone.

Figure 2A:
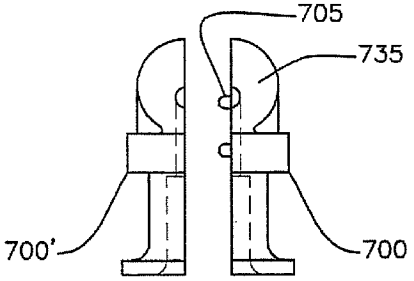
FIG. 2A illustrates a schematic top view of an embodiment of first and second insulator components.

FIG. 2A illustrates a schematic top view of a preferred embodiment of first and second insulator components 700 and 700' wherein first insulator component 700 comprises a plurality of alignment pins 705.

Figure 2B:
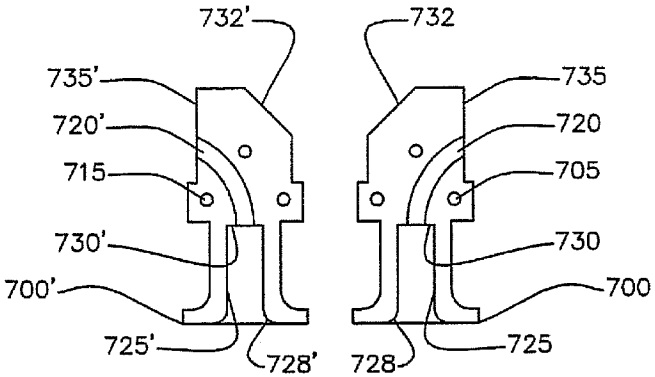
FIG. 2B illustrates a schematic side view of the first and second insulator components illustrated in FIG. 2A.

FIG. 2B illustrates a schematic side view of a preferred embodiment of first and second insulator components 700 and 700'. First insulator component 700 comprises alignment pins 705, guiding channel 720, partial bore 725, radius portion 728, annular shoulder 730, conical alignment surface 732, and second end surface 735. Second insulator component 700' comprises a plurality of alignment holes 715 corresponding with alignment pins 705 in first insulator component 700, guiding channel 720', partial bore 725', radius portion 728', annular shoulder 730', conical alignment surface 732', and second end surface 735'.

Figure 2C:
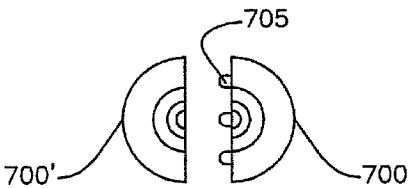
FIG. 2C illustrates a schematic end view of the first and second insulator components illustrated in FIG. 2A.

FIG. 2C illustrates a schematic end view of a preferred embodiment of first and second insulator components 700 and 700'.

Figure 2D:
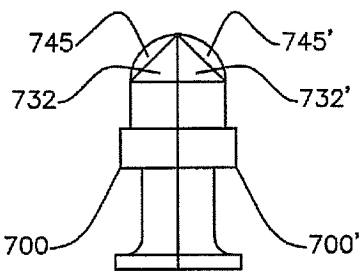
FIG. 2D illustrates a schematic anterior view of the first and second insulator components illustrated in FIG. 2A.

FIG. 2D illustrates a schematic anterior view of a preferred embodiment of first and second insulator components 700 and 700' illustrating faces 745 and 745' and conical alignment alignment surfaces 732 and 732'. First and second insulator components 700 and 700' are mated by inserting each of the plurality of alignment pins 705 into corresponding alignment holes 715.

Figure 2E:
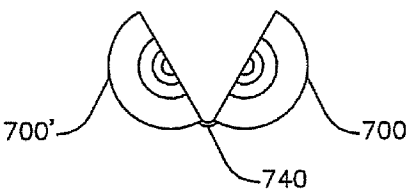
FIG. 2E illustrates a schematic end view of an alternate embodiment of first and second insulator components.

FIG. 2E illustrates a schematic end view of an alternate embodiment of first and second insulator components 700 & 700' wherein insulator components 700 and 700' are joined by flexible hinge member 740.

Figure 3A:
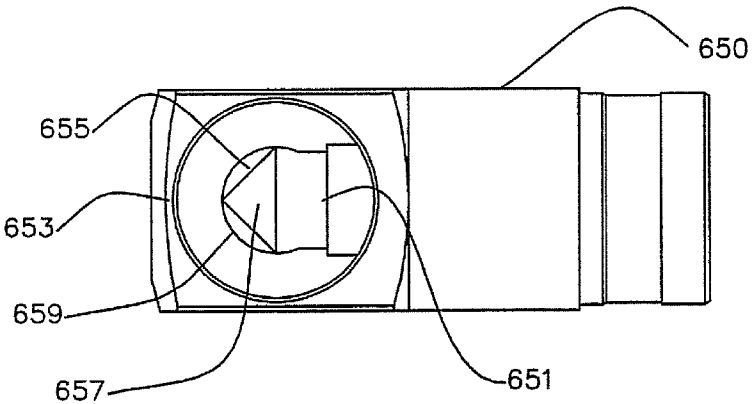
FIG. 3A illustrates a schematic top view of a main body of a connector as disclosed herein.

FIG. 3A illustrates a schematic top view of a preferred embodiment of main body 650 comprising bore 653, land 655, conical surface 657, keyhole 651, and bore 659.

Figure 3B:
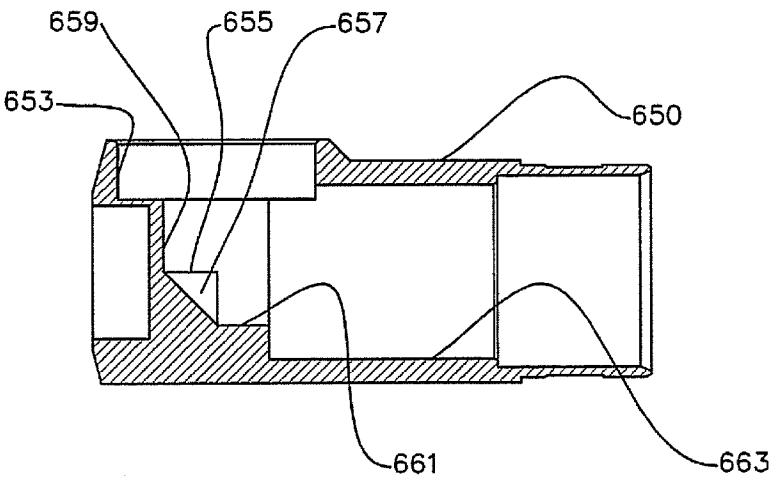
FIG. 3B illustrates a partial side cutaway view of the main body illustrated in FIG. 3A.

FIG. 3B illustrates a partial side cutaway view of a preferred embodiment of main body 650 comprising bore 653, land 655, conical surface 657, keyhole 651, bore 659, and bore 661.

Figure 4A:
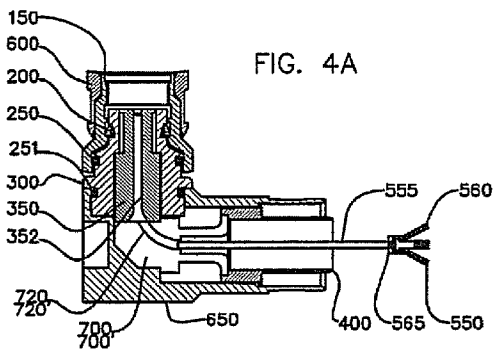
FIG. 4A illustrates a partial side cutaway view of the connector illustrated in FIG. 1 wherein pin is in a first stage of assembly.

FIG. 4A illustrates a partial side cutaway view along the centerline of the connector illustrated in FIG. 1 at a stage of factory assembly wherein insulating member, including first and second insulator components 700 and 700', has been disposed into the longitudinal opening 660 of main body 650 and pin 550 is at least partially installed but remains in the straight, or un-formed condition. Pin shank 555 is advanced proximate guiding channels 720 & 720' in preparation for insertion. Slotted fingers 560 may optionally be formed open or remain closed at this point of assembly. Slotted fingers 560 are illustrated as formed open in FIG. 4A. Conical alignment sections 732 & 732' of first and second insulator components 700 and 700' nestle in conical section 657 of main body 650 providing alignment and stability as well as forming structure for the electrical path. Faces 745 & 745' of first and second insulator components 700 and 700' abut land 655 of main body 650 providing mechanical support and ensure proper alignment of guide channels 720 & 720' with internal bore 352 of insulator 350. Keyhole 651 (as seen in FIG. 3B) is useful both for machining practices to control burrs and sharp edges in the manufacturing process and for electrical tuning of the coaxial structure.

Figure 4B:
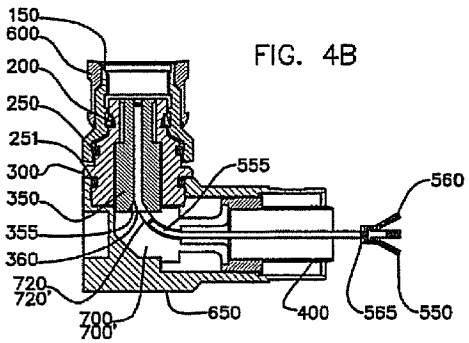
FIG. 4B illustrates a partial side cutaway view of the connector illustrated in FIG. 1 wherein pin is in a second stage of assembly.

FIG. 4B illustrates a partial side cutaway view along the centerline of a preferred embodiment of a connector at a stage of factory assembly wherein pin shank 555 is at least partially installed and partially formed along the guiding channels 720 & 720'. The malleable nature of pin shank 555 allows pin shank 555 to be urged along a swept portion of the opening of insulating member, namely the swept path defined by guiding channels 720 and 720' of first and second insulator components 700 and 700'.

Optionally, the assembly state of pin 550 and first and second insulator components 700 and 700' as illustrated in FIG. 4B may be achieved outside of main body 650 as a sub-assembly and then subsequently installed within main body 650 then encapsulated within main body 650 by post 400.

Figure 4C:
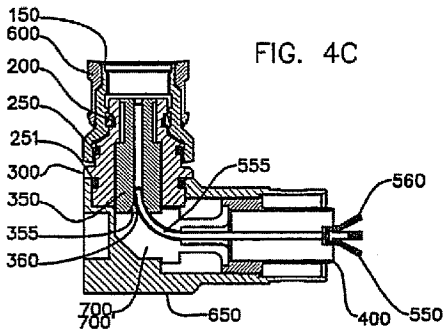
FIG. 4C illustrates a partial side cutaway view of the connector illustrated in FIG. 1 wherein pin is in a third stage of assembly.

FIG. 4C illustrates a partial side cutaway view along the centerline of a preferred embodiment of a connector at a stage of factory assembly wherein pin 550 is at least partially installed and formed along the inner contours of first and second insulator components 700 and 700' and at least partially installed within the internal bore 352 of insulator 350. Tapered portion 355 and radius 360 of insulator 350 both acts as a guide for pin shank 555 and approximates the continuance of the swept path initiated by guiding channels 720 & 720' defined by first and second insulator components 700 and 700'.

Figure 4D:
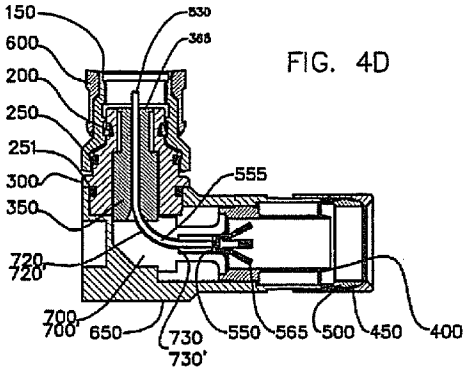
FIG. 4D illustrates a partial side cutaway view of the connector illustrated in FIG. 1 wherein pin is in a final stage of assembly.

FIG. 4D illustrates a partial side cutaway view along the centerline of a preferred embodiment of a connector at a stage of factory assembly wherein pin shank 555 is at least partially installed and formed along the inner contours of first and second insulating components 700 and 700' and at least partially installed within the internal bore 352 of insulator 350 wherein the second end 554 of pin 550 protrudes beyond proximal end 365 of insulator 350. Optionally, pin 550 may be configured to be recessed below proximal end 365 of insulator 350. Slotted fingers 560 proximate to first end 552 of pin 550 are flared and positioned proximate partial bores 725 & 725'. Compression Ring 450 and gripping member 500 are shown as installed but not compressed. FIG. 4D illustrates an "as shipped" condition in which the end user would receive the connector for field installation of cable and final connection.

As can be seen by comparing FIG. 4A with FIG. 4D, in FIG. 4A the longitudinal axis of first end 552 of pin 550 and the longitudinal axis of second end 554 of pin 550 are generally coaxial as pin is inserted into the opening of insulating member whereas in FIG. 4D the longitudinal axis of first end 552 of pin 550 and the longitudinal axis of second end 554 of pin 550 are generally perpendicular, such as at a right angle (90°) relative to each other.

Figure 4E:
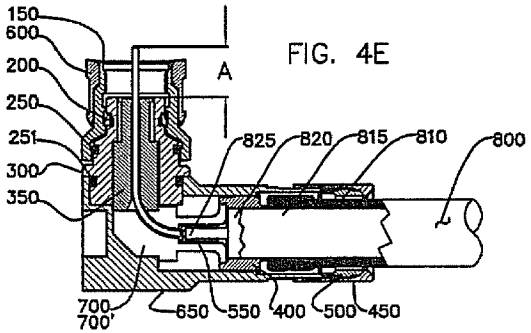
FIG. 4E illustrates a partial side cutaway view of the connector illustrated in FIG. 1 wherein the connector is partially installed on a coaxial cable.

FIG. 4E illustrates a partial side cutaway view along the centerline of a preferred embodiment of a connector at a stage of end user assembly wherein a prepared coaxial cable 800 is inserted at least partially into post 400. As cable center conductor 825 is advanced into the connector assembly, pin 550 is forced further along the guided path previously described. Contact shoulder 565 abuts counter bore 730 arresting further movement. At this point, proximal end of pin 550 protrudes to dimension "A" proving a visual reference indicating full and complete cable insertion (pop up pin). Cable center conductor 825 is captured within the tines of contact 550 which are urged radially inwardly by partial bores 725 & 725' during the described cable insertion sequence.

Figure 4F:
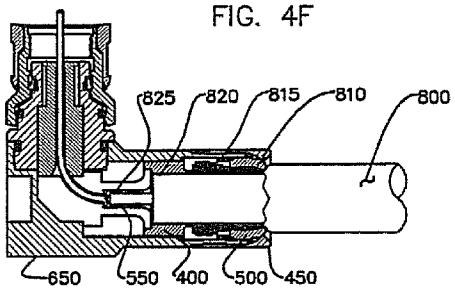
FIG. 4F illustrates a partial side cutaway view of the connector illustrated in FIG. 1 wherein the connector is fully installed on a coaxial cable.

FIG. 4F is a partial side cutaway along the centerline of a preferred embodiment of a connector at a stage of end user assembly wherein the connector is fully installed on a coaxial cable 800. Coaxial cable 800 includes a center conductor 825 surrounded by a dielectric 820, the dielectric surrounded by an outer conductor 815, and the outer conductor being surrounded by a jacket 810. Compression ring 450 is axially advanced about main body 650 such that in a forward position, at least a portion of the deformable gripping member 500 is compressed radially inward by the main body 650 and the compression ring 450 such that deformable gripping member 500 is in a compressed condition about coaxial cable 800.

As shown in FIGS. 4D-4F, in response to insertion of coaxial cable 800 into first end 102 of connector, pin 550 is capable of moving along the opening of insulating member from a first position (shown, e.g., in FIG. 4D), in which the second end 554 of the pin 550 does not extend beyond the second end 104 of the connector, to a second position (shown, e.g., in FIG. 4E), in which the second end 554 of the pin 550 extends beyond the second end 104 of the connector.

In addition, as shown in FIGS. 4D-4E the first end 552 of the pin 550 extends within an internal bore of the post 400 in the first position (shown, e.g., in FIG. 4D) and does not extend within an internal bore of the post 400 in the second position (shown, e.g., in FIG. 4E).

Figure 5B:
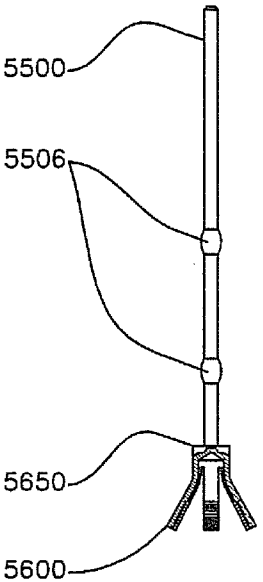
FIG. 5B illustrates a partial side cutaway view of another alternate embodiment of pin.
Figure 5A:
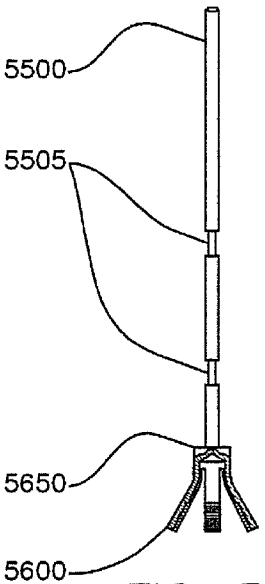
FIG. 5A illustrates a partial side cutaway view of an alternate embodiment of pin.
Figure 7A:
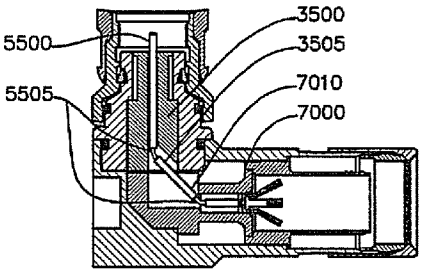
FIG. 7A illustrates a partial side cutaway view of an alternate embodiment of a connector as disclosed herein.
Figure 7B:
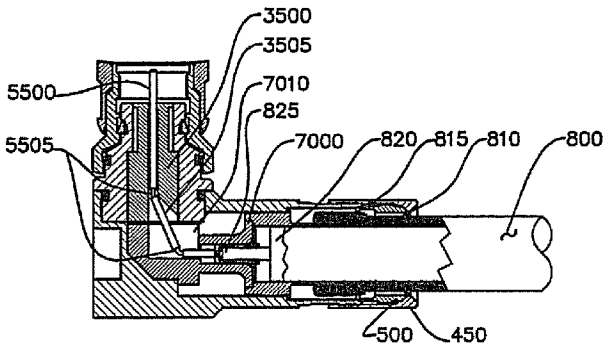
FIG. 7B illustrates a partial side cutaway view of the connector illustrated in FIG. 7A wherein the connector is partially installed on a coaxial cable.
Figure 7C:
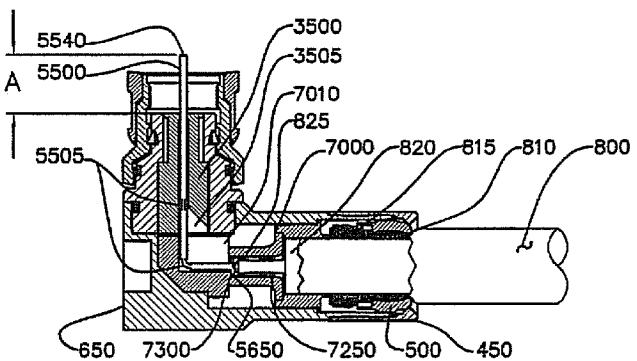
FIG. 7C illustrates a partial side cutaway view of the connector illustrated in FIG. 7A wherein the connector is fully installed on a coaxial cable.

FIG. 5A illustrates a partial side cutaway view of an alternate embodiment of pin 5500 comprising at least one stepped joint 5505 (shown as two joints in FIG. 5A) wherein pin 5500 longitudinally extends along a first and second axis on either side of the at least one stepped joint 5505. Pin 5500 includes slotted fingers 5600 and contact shoulder 5650. Stepped joint 5505 is preferably formed by turning a reduced portion of the pin to a smaller diameter to enhance diameter to enhance flexibility. Stepped joint 5505 facilitates the pop-up action of pin 5500 as shown in FIGS. 7A-7C.

FIG. 5B illustrates a partial side cutaway view of an alternate embodiment of pin 5500 comprising at least one stamped joint 5506 (shown as two joints in FIG. 5B) wherein pin 5500 longitudinally extends along a first and second axis on either side of the at least one stamped joint 5506. Pin 5500 includes slotted fingers 5600 and contact shoulder 5650. Stamped joint 5506 is preferably formed by a method commonly known as stamping or coining Stamped joint 5506 facilitates the pop-up action of pin 5500 as shown in FIGS. 7A-7C.

Figure 6B:
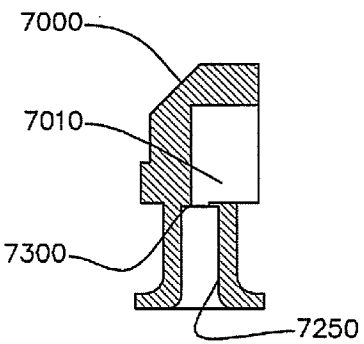
FIG. 6B illustrates a partial side cutaway view of the embodiment of insulating member illustrated in FIG. 6A.
Figure 6A:
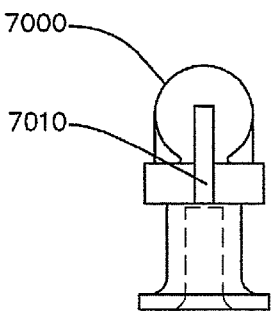
FIG. 6A illustrates a schematic top view of an alternate embodiment of insulating member.

FIG. 6A illustrates a schematic top view of an alternate embodiment of insulating member 7000 that includes slotted relief 7010. Slotted relief 7010 provides a controlled path for the movement of pin 5500.

FIG. 6B illustrates a partial side cutaway view of an alternate embodiment of insulating member 7000 that includes slotted relief 7010, partial bore 7250, and annular shoulder 7300. Slotted relief 7010 provides a controlled path for the movement of pin 5500.

FIG. 7A illustrates a partial side cutaway view along the centerline of an alternate embodiment at a stage of factory assembly wherein pin 5500 is at least partially installed and is illustrated in the "as shipped" condition in which the end user would receive the connector for field installation of cable and final connection. Joints 5505 allow pin 5500 to follow the controlled path defined by slotted relief 7010 of insulating member 7000 and slotted relief 3505 of insulator 3500.

FIG. 7B illustrates a partial side cutaway view along the centerline of an alternate embodiment at a stage of end-user assembly wherein a prepared coaxial cable 800 is inserted at least partially into post 400. As cable center conductor 825 is advanced into the connector, pin 5500 is forced further along the guided path previously described. Contact shoulder 5650 abuts annular shoulder 7300 arresting further movement.

FIG. 7C illustrates a partial side cutaway view along the centerline of an alternate embodiment at a stage of end-user assembly wherein a prepared coaxial cable 800 is fully inserted into post 400. At this point, second end 5540 of pin 5500 protrudes to dimension "A" proving a visual reference indicating full and complete cable insertion (pop up pin). Cable center conductor 825 is captured within the tines of contact 5500 which are urged into partial bore bore 7250 of insulating member 7000 during the previously described cable insertion sequence. After which, compression ring 450 is axially advanced about main body 650 such that in a forward position, at least a portion of the deformable gripping member 500 is compressed radially inward by the main body 650 and the compression ring 450 such that deformable gripping member 500 is in a compressed condition about coaxial cable 800.

As shown in FIGS. 7A-7C, in response to insertion of coaxial cable 800 into first end 102 of connector, pin 5500 is capable of moving along the opening of insulating member from a first position (shown, e.g., in FIG. 7A), in which the second end 5540 of the pin 5500 does not extend beyond the second end 104 of the connector, to a second position (shown, e.g., in FIG. 7C), in which the second end 5540 of the pin 5500 extends beyond the second end 104 of the connector. Pin 5500 extends along a first axis and second axis on either side of at least one joint 5505 and as pin 5500 moves from the first position to the second position, an angle between the first axis and the second axis changes.

In addition, as can be seen by comparing FIG. 5A with FIG. 7A, the first axis and the second axis on either side of at least one joint 5505 are generally coaxial prior to insertion of the pin 5500 into the connector or the opening of insulating member 7000 (FIG. 5A) whereas the first axis and the second axis on either side of at least one joint 5505 are not coaxial when the pin has been fully inserted into the opening of the insulating member 7000 (FIG. 7A).

While the embodiments illustrated above show the cable side entry end (e.g., first end 102) of the connector as including an axially moveable compression ring and deformable gripping member, other mechanisms and methods of securing a coaxial cable to the connector can also be employed. Such mechanisms and methods include, but are not limited to those disclosed in, for example, U.S. Pat. Nos. 7,018,235, 7,179,121, 7,182,639, 5,975,951, 7,331,820, 7,144,272, and 5,338,225, the disclosures of which are hereby incorporated by reference in their entirety.

It will be apparent to those skilled in the art that various modifications and variations can be made without departing from the spirit and scope of the invention.

What is claimed is:

1. A coaxial connector for attachment to a coaxial cable, the coaxial cable having a center conductor and a dielectric insulator surrounding the center conductor, the coaxial connector having a first end and a second end, the connector comprising:

a main body having a first end and a second end and an internal surface extending between the first end and the second end, the internal surface defining a longitudinal opening, the main body also having a first opening at the first end and a second opening at the second end, each opening having a longitudinal axis therethrough, the longitudinal axis of the first opening being generally perpendicular to the longitudinal axis of the second opening;

an insulating member disposed in the longitudinal opening of the main body, the insulating member having a first end, a second end, and an opening extending between the first and second ends of the insulating member;

a pin extending substantially along the opening of the insulating member, the pin having a first end and a second end, each end having a longitudinal axis therethrough, the longitudinal axis of the first end of the pin being generally perpendicular to the longitudinal axis of the second end of the pin;

wherein the pin is capable of moving along the opening of the insulating member from a first position, in which the second end of the pin does not extend beyond the second end of the connector, to a second position, in which the second end of the pin extends beyond the second end of the connector, in response to insertion of the coaxial cable into the first end of the connector.

2. The coaxial connector of claim 1, wherein the second end of the connector comprises a coupling nut having an internally threaded bore for engaging a port, said coupling nut comprising a first external gripping surface having a plurality of flat sides and a second external gripping surface having a plurality of flat sides, wherein a smallest outer diameter of the first external gripping surface is less than a smallest outer diameter of the second external gripping surface.

3. The coaxial connector of claim 2, wherein the first and second external gripping surfaces are hex-shaped.

4. The coaxial connector of claim 2, wherein the connector comprises a body member having a first end and a second end, the first end of the body member disposed through the second opening of the main body and the second end of the body member disposed within an inner surface of the coupling nut.

5. The coaxial connector of claim 4, wherein the connector comprises an o-ring disposed about said body member and within the inner surface of the coupling nut, said coupling nut being permitted limited axial movement relative to said body member before the internally threaded bore engages the port, said limited axial movement allowing said coupling nut to be free-spinning relative to said body member until said coupling nut is tightened onto the port.

6. The coaxial connector of claim 4, wherein the connector comprises a c-shaped retaining ring having a front end and a back end, said c-shaped retaining ring disposed about said body member proximate to the second end thereof and disposed within the inner surface of the coupling nut, wherein said c-shaped retaining ring comprises an external taper and increases in outside diameter between said front end and said back end.

7. The coaxial connector of claim 1, wherein the opening of the insulating member comprises a swept portion.

8. The coaxial connector of claim 1, wherein the pin comprises at least one joint between said first end and said second end, said pin extending along a first and second axis on either side of said joint, wherein movement of the pin from said first position to said second position causes an angle between the first axis and the second axis to change.

9. The coaxial connector of claim 1, wherein the pin has a flared portion at said first end to assist in guiding the inner conductor of the coaxial cable into physical and electrical contact with the pin.

10. The coaxial connector of claim 1, wherein the connector comprises:

a compression ring surrounding the first end of the main body, said compression ring comprising a front end, a rear end, and an inner surface defining a longitudinal opening extending between the front and rear ends of the compression ring, wherein the compression ring is axially moveable over the main body between a rearward position and a forward position; and a deformable gripping member disposed within the longitudinal opening of the compression ring;

wherein, in the forward position, at least a portion of the deformable gripping member is compressed radially inward by the main body and the compression ring.

11. The coaxial connector of claim 1, wherein said insulating member comprises a first insulator component and a second insulator component, said first insulator component comprising a plurality of alignment pins and said second insulator component comprising a plurality of corresponding alignment holes, wherein the first insulator component and the second insulator component are mated by inserting each of the plurality of the alignment pins into the corresponding alignment holes.

12. The coaxial connector of claim 1, wherein said insulating member comprises a first insulator component and a second insulator component, wherein the first insulator component and the second insulator component are joined by a hinge member.

13. The coaxial connector of claim 1, wherein the connector comprises a tubular insulator disposed between the second end of the insulating member and the second end of the connector.

14. The coaxial connector of claim 1, wherein the connector comprises a tubular post disposed within the longitudinal opening of the main body, said post comprising a tubular shank having a rear end, an inner surface and an outer surface, and wherein the outer surface of the tubular shank and the internal surface of the main body define an annular cavity therebetween.

15. The coaxial connector of claim 14, wherein the first end of the pin extends within an internal bore of the post in the first position and does not extend within an internal bore of the post in the second position.

16. A method of assembling a connector for coupling an end of a coaxial cable to a port, the coaxial cable having a center conductor surrounded by a dielectric, the dielectric surrounded by an outer conductor, and the outer conductor surrounded by a jacket, said method comprising:

disposing an insulating member into a longitudinal opening in a main body of the connector, the insulating member having a first end, a second end, and an opening extending between the first and second ends of the insulating member and the main body having a first end and a second end and an internal surface extending between the first end and the second end, the internal surface defining the longitudinal opening, the main body also having a first opening at the first end and a second opening at the second end, each opening having a longitudinal axis therethrough, the longitudinal axis of the first opening being generally perpendicular to the longitudinal axis of the second opening;

inserting a pin into and substantially along the opening of the insulating member, the pin having a first end and a second end, each end having a longitudinal axis therethrough, wherein the longitudinal axis of the first end of the pin and the longitudinal axis of the second end of the pin are generally coaxial prior to insertion of the pin into the opening of the insulating member and the longitudinal axis of the first end of the pin and the longitudinal axis of the second end of the pin are generally perpendicular when the pin has been fully inserted into the opening of the insulating member; and wherein the pin comprises at least one joint between its first end and second end, said pin extending along a first and second axis on either side of said at least one joint, wherein said first axis and said second axis are generally coaxial prior to insertion of the pin into the opening of the insulating member and said first axis and said second axis are not coaxial when the pin has been fully inserted into the opening of the insulating member.

17. The method of claim 16, wherein the opening of the insulating member comprises a swept portion.

18. The method of claim 16, wherein said insulating member comprises a first insulator component and a second insulator component, said first insulator component comprising a plurality of alignment pins and said second insulator component comprising a plurality of corresponding alignment holes, wherein the first insulator component and the second insulator component are mated by inserting each of the plurality of the alignment pins into the corresponding alignment holes.

19. The method of claim 16, wherein said insulating member comprises a first insulator component and a second insulator component, wherein the first insulator component and the second insulator component are joined by a hinge member.

* * * * *